US005690422A

United States Patent [19]

Brass

[11] Patent Number: 5,690,422

[45] Date of Patent: Nov. 25, 1997

[54] SHARP-CUTOFF LUMINAIRE HAVING SPECULAR REFLECTING FACETS WITH FAN-LINE GEOMETRY

[75] Inventor: John R. Brass, San Anselmo, Calif.

[73] Assignee: Lighting Research & Development, Inc., San Anselmo, Calif.

[21] Appl. No.: 533,200

[22] Filed: Sep. 25, 1995

[51] Int. Cl.[6] ..... F21V 7/12

[52] U.S. Cl. ..... 362/297; 362/348

[58] Field of Search ..... 362/297, 346, 362/348, 349

[56] References Cited

U.S. PATENT DOCUMENTS

| | | | |
|---|---|---|---|
| 704,711 | 7/1902 | Carlstedt | 362/348 |
| 1,284,019 | 11/1918 | Wood | 362/349 |
| 4,575,788 | 3/1986 | Lewin | 362/297 |
| 5,192,124 | 3/1993 | Kawashima et al. | 362/297 |
| 5,426,575 | 6/1995 | Richards | 362/297 |

*Primary Examiner*—Ira S. Lazarus
*Assistant Examiner*—Sara Sachie Raab

[57] ABSTRACT

A fan-line optical principle for use in the design of faceted specular reflectors for sharp-cutoff luminaires is disclosed, and a luminaire embodying this optical principle is described. The luminaire described comprises a high intensity arc discharge lamp, providing a primary light source with finite length and thickness, and a reflector including a plurality of specular reflecting facets with fan-line geometry. Each of these fan-line facets displays (in a given main beam direction) a primary light source image that is parallel and adjacent to the cutoff edge of that facet. The name of this invention relates to the fact that a perspective view toward the front of a sharp-cutoff luminaire embodying the invention shows that fan-line facets, and the images they produce, create a fan-like pattern. An important characteristic of the invention is that the images of the primary light source displayed by fan-line facets, at a given main beam angle, can show substantially all of the primary light source.

11 Claims, 3 Drawing Sheets

SHARP-CUTOFF LUMINAIRE HAVING SPECULAR REFLECTING FACETS WITH FAN-LINE GEOMETRY

FIELD OF INVENTION

This invention relates generally to luminaires and more particularly to a luminaire of the sharp-cutoff type having specular reflecting facets with fan-line geometry.

DISCUSSION OF PRIOR ART

Luminaires of the sharp-cutoff type, for the illumination of areas, and the things situated thereon, have been available for about 26 years. Sharp-cutoff luminaires having specular reflecting facets have been available for about 24 years. The areas to be lighted by such luminaires include interior and exterior visual task planes, floors, ceilings, walls, pedestrian and vehicular traffic areas, parking areas, malls, plazas, sports courts and fields, signs, display surfaces, etc. Depending on the application, the light emitting side of this type of luminaire may be horizontal, tilted or vertical and may face downward or upward. Luminaires for these applications go by different names such as: floodlight, street light, roadway luminaire, walkway luminaire, area luminaire, task light, sign sight, uplight, downlight, etc. and someday will probably include vehicular headlights.

A luminaire of the sharp-cutoff type produces relatively high beam strength toward the perimeter of predetermined area zone that the luminaire is designed to light. In this way the illumination falling on a much larger area lighted by a system of such luminaires, at many different locations, is made to have appropriate uniformity. The term "sharp-cutoff" relates to a light distribution characteristic, as described above, which also sharply attenuates the amount of light (glare and spill light) directed beyond the area zone.

An energy efficient electric lamp (light bulb) of the type favored today for use in such luminaires consists of a high intensity electric arc tube enclosed in a protective clear (transparent) glass bulb. When the arc tube is also transparent, the electric arc within the tube may be seen (through a welding a mask lens) to have finite length and thickness, and the arc itself is the primary light source. That is why it is common design practice to represent the primary light source as a cylindrical form having a length and diameter equal to the length and maximum thickness of the banana shaped electric arc. The types of electric lamps available today that are particularly suitable for use in sharp-cutoff luminaires include high pressure sodium, metal halide, and tungsten halogen.

Prior art reflectors of the sharp-cutoff type usually have reflectors that are faceted rather than smooth. Faceted reflectors can be formed in one piece from high purity aluminum sheet (spun, drawn, hydroformed, etc.). They can then be given a specular or semi-specular finish after fabrication. However, in recent years the cost of highly specular finishes on such reflectors has become prohibitive. Today, sharp-cutoff reflectors are usually fabricated from highly specular aluminum reflector sheet having a prefinished surface that reflects 85 to 94 percent of the incident light. Fabricated reflector assemblies have been of the full-shell type (all facets having contiguous edges and assembled together in a substantially rigid form) or have consisted of several bent strips of reflector sheet secured to a supporting structure. Such strips are vulnerable to bending during maintenance (cleaning, etc.) and are relatively difficult to clean.

The geometry of most prior art reflectors of the sharp-cutoff type has been greatly influenced by tooling conventions and the reflector design technique called "ray tracing". This technique is the conventional method used to determine the geometry of various cross-sections of the reflector and the forming tool. Since a light ray line must begin at a point, the center of the primary light source is usually considered to be the point from which all light is emitted. However, most light sources are not point sources. Only certain clear bulb type, incandescent and tungsten halogen lamps have primary light sources (filaments) that come close to satisfying the definition of a point source (and then only if the reflector has dimensions that are very much larger than the filament). The end result produced by reflectors designed by ray tracing is that primary light sources (having a finite length and thickness) are often partially imaged in a way that does not optimize illumination uniformity and efficiency and the control of glare and spill light.

Fan-line geometry and the unique image plotting technique used to develop this geometry are the keys to the invention described herein. This image plotting technique uses the three dimensional mirroring and plane rotation commands of a computer aided design program. No ray tracing is required when this image plotting technique is used.

OBJECTS AND ADVANTAGES

The objects and advantages of the invention, as compared to prior art sharp-cutoff luminaires (using the same light source) are:

(a) to allow a significant increase in the size of the area zone illuminated (with appropriate uniformity) by a luminaire, (b) to provide significantly increased illumination levels around the perimeter of the area zone lighted by a luminaire, (c) to significantly increase the amount of light source output directed to the area zone (improved utilization of light source output), (d) to significantly reduce the amount of light source output directed beyond the area zone (sharp-cutoff of glare and spill light), (e) to allow the design of lighting systems utilizing this invention that can satisfy or exceed a given minimum illumination requirement, where prior art sharp-cutoff luminaires would have to be spaced closer together or, conversely, to allow the design of lighting systems utilizing this invention that will satisfy a given minimum illumination requirement where a greater number of prior art sharp-cutoff luminaires would be required at each mounting position or each prior art sharp-cutoff luminaire would have to be larger, more expensive and more power consumptive, (f) to provide significant reductions in initial and long term costs for lighting system equipment, energy and maintenance.

BRIEF SUMMARY OF THE INVENTION

This invention involved the discovery of an optical principle; namely, that a specular reflecting facet with fan-line geometry can display (in a given main beam direction) a primary light source image that is parallel and adjacent to the cutoff edge of that facet, even if that edge is not parallel to the light source axis. The name of this invention relates to the fact that a perspective view toward the front of a sharp-cutoff luminaire embodying the invention shows that fan-line facets, and the images they produce, create a fan-like pattern.

An important characteristic of the invention is that the images of the primary light source displayed by fan-line facets, at a given main beam angle can show substantially all of the primary light source. Prior art faceted mirror designs display partial images of the light source, because those images intersect facet edges rather than lying parallel to a cutoff edge. This characteristic of prior art sharp-cutoff luminaires limits their main beam intensities.

Figure 1:
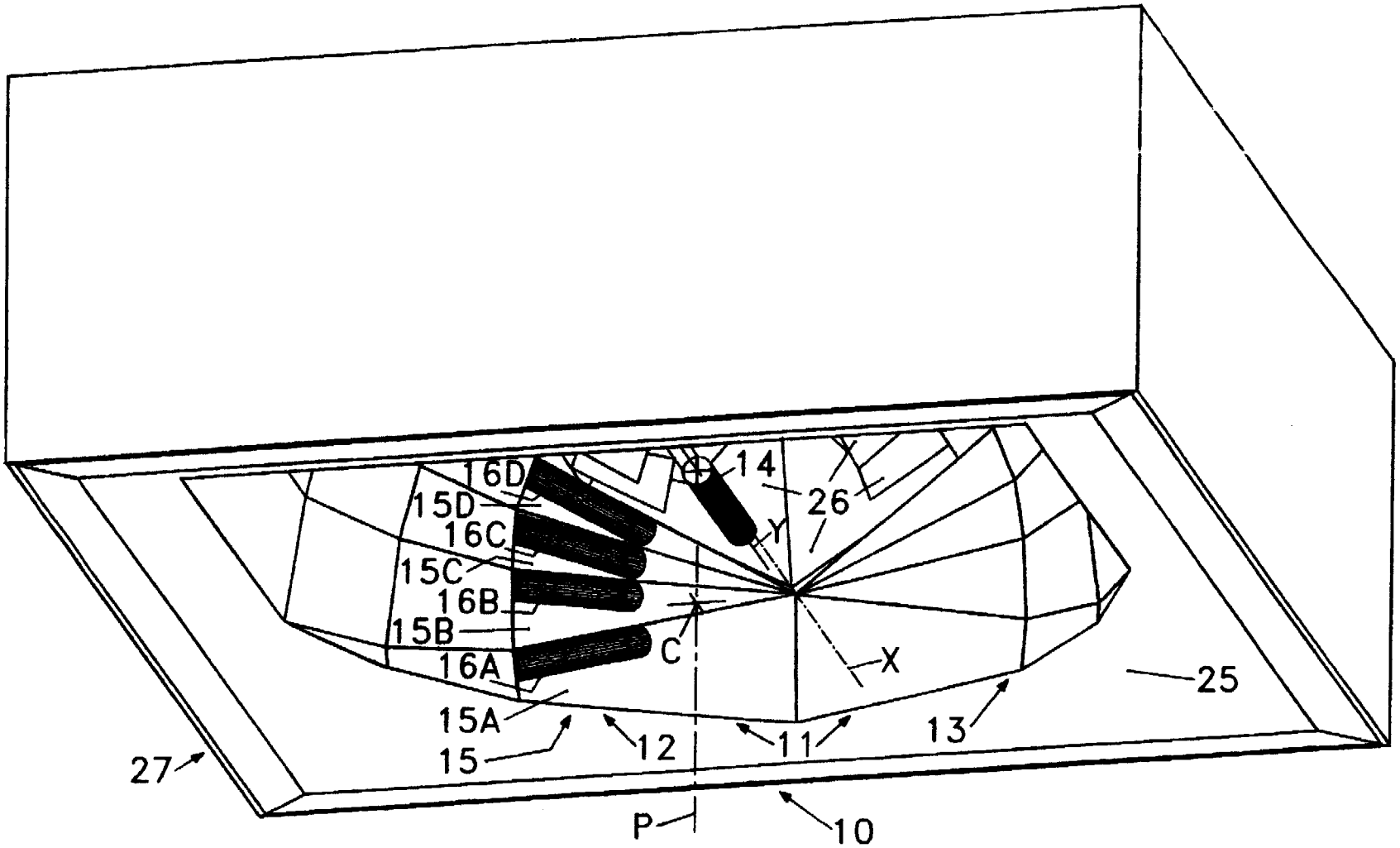
FIG. 1 shows a perspective view of a luminaire embodying the present invention. This view shows the geometry of a particular arrangement of fan-line facets and how the primary light source and the mirror images of that source are displayed by the luminaire in the direction of one of its main beams.
Figure 2:
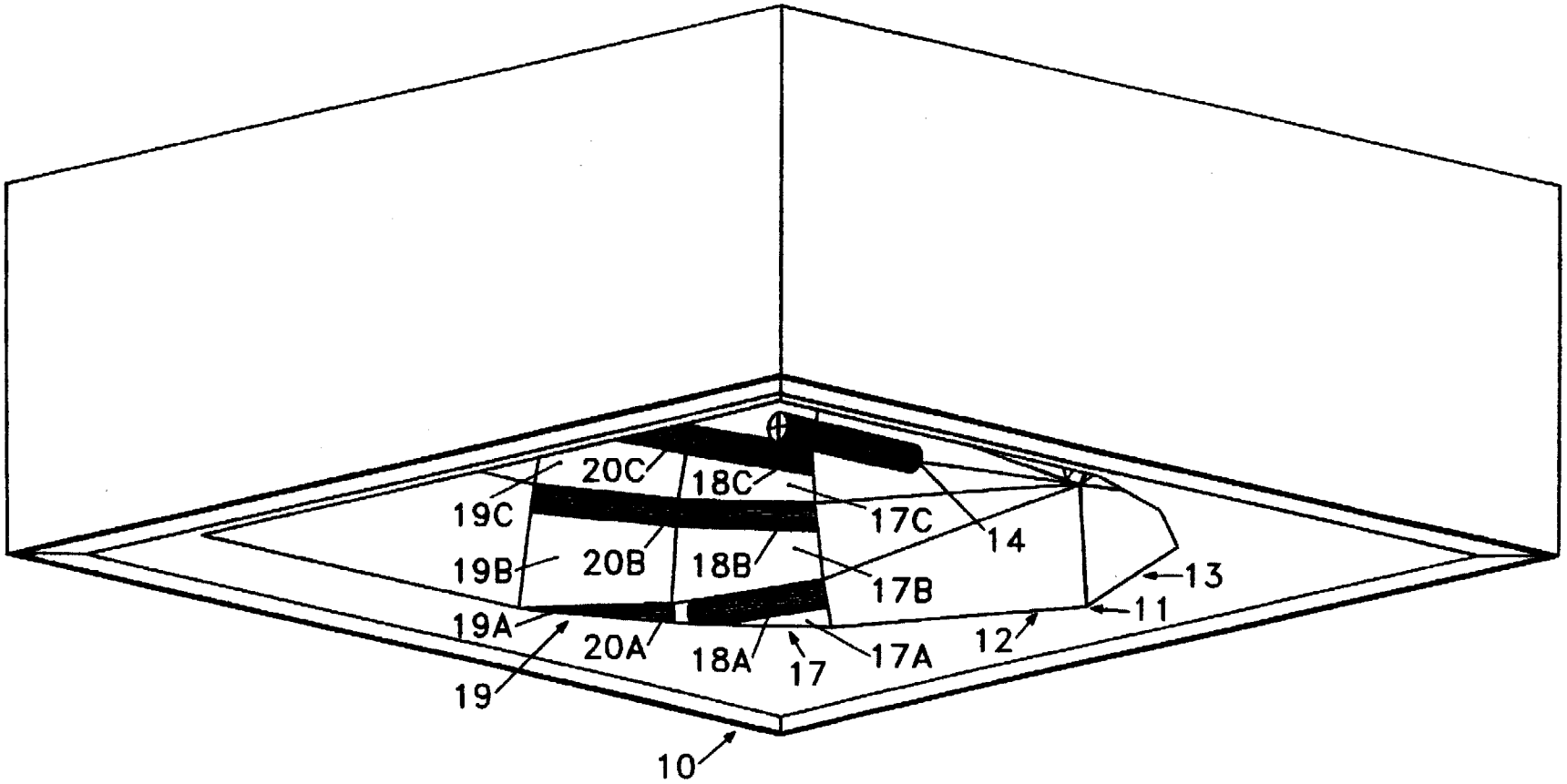
FIG. 2 is similar to FIG. 1, except that it shows how the primary light source and its images are displayed in the direction of a second main beam.
Figure 3:
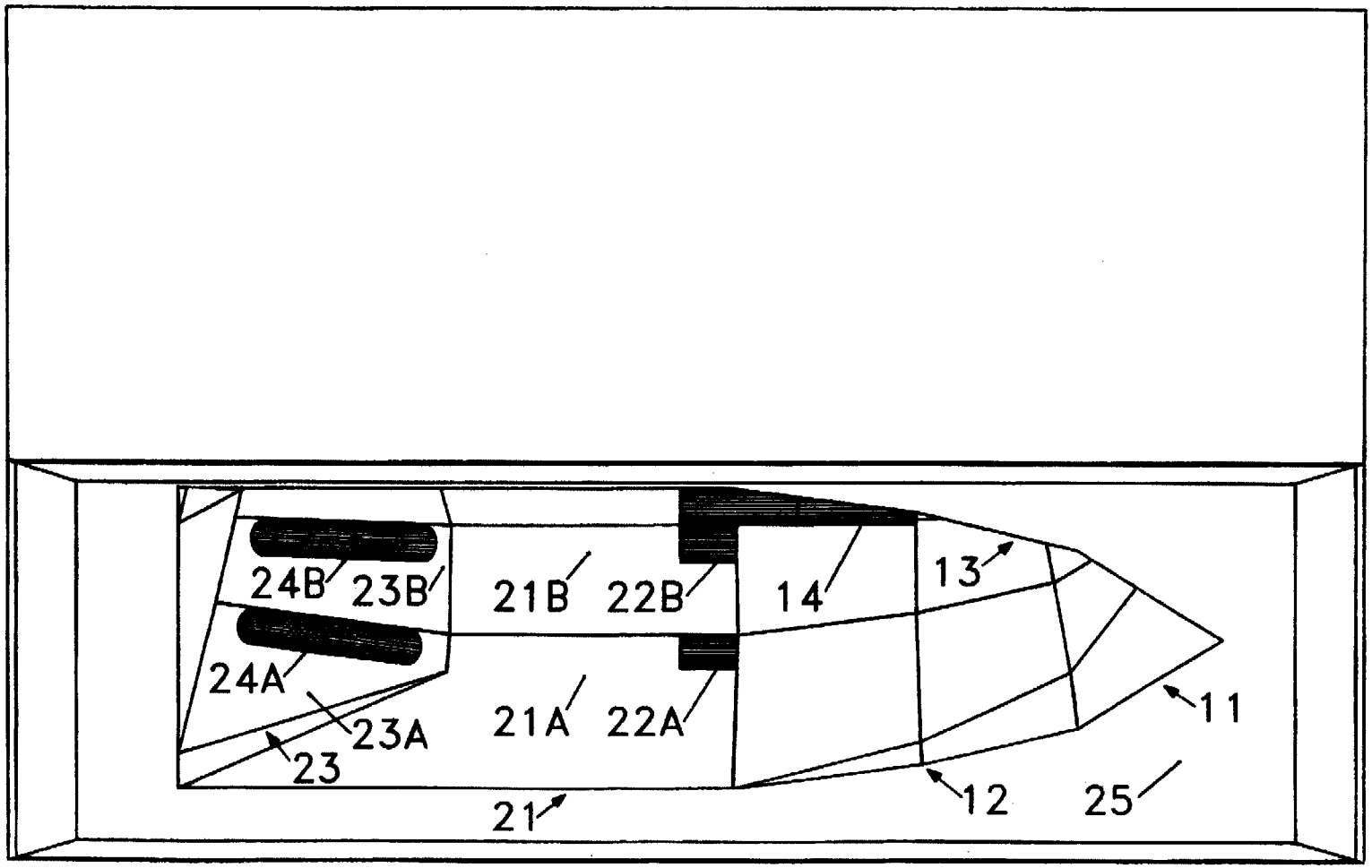
FIG. 3 is also similar to FIG. 1, except that it shows how the primary light source and its images are displayed in the direction of the third main beam.

It should be noted that the mirror images of the primary light source shown in FIGS. 1, 2 and 3 are not simply drawn on each fan-line facet face. Those images are plotted in 3D computer model space at a distance behind each facet that is equal to the distance from the primary light source to the face of each facet. If this 3D computer model is viewed from a slightly different angle than the one shown, the images will move slightly in the same way they would move if a physical model of the invention were being viewed. To this inventor's knowledge, the 3D mirroring and plane rotation commands of a 3D computer drawing program have never been used before to directly design a luminaire reflector having specular (mirrorlike) facets. No traditional ray tracing was used in the design of the reflector disclosed herein.

DETAILED DESCRIPTION

FIG. 1 shows a geometrically precise perspective view of one of the many practical embodiments of the present invention. This is a perspective view (from a distance of 30 meters) of luminaire 10 along a specific line of sight to it photometric center. That line of sight corresponds (but in reverse) to the direction of one of the main beams of light produced by luminaire 10 toward a particular point on the area lighted by the luminaire. The coordinates of that point as referred to planar area zone grid (for this view of this particular embodiment of the invention) are 3.0 luminaire mounting distances forward and 0.23 luminaire mounting distances to the right (for the basis of these coordinates see paragraph 3 of this section). The beam strength produced by this invention, toward this specific point on the planar area zone grid, greatly exceeds the beam strength produced by prior art cross-beam, sharp cutoff luminaires in that direction.

For this embodiment of the invention, reflector side section 13 (a "mirrored" version of reflector side section 12) directs a beam of light to the left side of the planar area zone grid that is comparable to the beam produced by reflector side section 12.

By convention, the zero, zero coordinate point on an imaginary planar area zone grid is determined by the intersection of photometric axis P of luminaire 10 with that grid, when the photometric axis is perpendicular to the grid plane. The luminaire mounting distance for luminaire 10 is the distance along a photometric axis P from the planar area zone grid to the photometric center C of luminaire 10, and one grid unit is equal to one luminaire mounting distance. For this embodiment of the invention, fan-line vertex axis X is parallel to the planar area zone grid line that runs "forward" of the zero, zero coordinate point.

As shown in FIG. 1, fan-line facets 15A, 15B, 15C and 15D in tiered facet group 15 each have a cutoff edge that lies on a fan-line, and all of the fan-lines for this facet group intersect at one point on fan-line vertec axis X. Fan-line facets 15A, 15B, 15C and 15D are each given a spatial angle (using the CAD image plotting method) that creates, for the line of sight of this view, images 16A, 16B, 16C and 16D (respectively) of primary light source 14 that are parallel, and adjacent to the cutoff edge of the corresponding facet.

It is this imaging characteristic of fan-line facets that provides much greater light beam intensities (than produced by prior art sharp cut-off luminaires) toward points along the perimeter of a rectangular planar area zone grid that extends 3 luminaire mounting distances forward and 3 mounting heights to the left or right. At the same time, the face that these images disappear simultaneously and rapidly (behind the cutoff edge of each fan-line facet) as the viewing angle, relative to the photometric axis, increases, ensures unusually sharp cutoff of glare and spill light.

For the embodiment of the invention shown in FIG. 1, reflector side sections 12 and 13 of luminaire 10 are disposed symmetrically on each side of a longitudinal center-plane. This embodiment of the invention is a so called "cross-beam" luminaire. The term "cross-beam" refers to a luminaire that produces at least two main beams of light from a single light source, and these main beams cross each other as they leave the luminaire. Such reflectors are structually symmetrical about a longitudinal center plane, but the light distribution pattern can be symmetrical or asymmetrical. For some applications, however, it is desirable to use so called "unidirectional" luminaires. One unidirectional embodiment of this present invention would require only one reflector side section having specular reflecting facets with fan-line geometry.

Luminaire 10 has a photometric axis P lying in its center-plane and a photometric center C on that axis. The photometric center C of luminaire 10 is at the center of the square plane established by the light emitting side of luminaire housing 27, and that plane is perpendicular to photometeric axis P. Fan-line vertex axis X lies in the longitudinal center-plane of reflector 11 and is perpendicular to photometric axis P.

In this embodiment of the invention, primary light source 14 is enclosed in a transparent bulb which is installed in a standard lampholder at the front of luminaire 10 (lampholder not visible in FIG. 1). For illustrative clarity, the transparent bulb outline is not shown. The longitudinal axis Y of primary light source 14 lies substantially in the longitudinal center-plane of reflector 11 and is approximately perpendicular to photometric axis P. The distance between fan-line vertex axis X and light source axis Y is approximately equal to one-half the diameter of primary light source 14.

No method of mounting luminaire 10 at a given luminating mounting distance from the area zone is shown, since the mounting method will vary with the application. Such methods, however, include recessed, surface, pendant, arm and bracket mountings, and the light emitting side of luminaire 10 may have any spatial orientation suitable for an application.

Since the invention disclosed herein pertains specifically to fan-line facets, no construction details are given for central reflector section 26. It should be noted, however, that central reflector section 26 is disposed, in a substantially symmetrical manner, on the side of reflector 11 that is farthest from the light emitting side of luminaire 10, whereby the light from primary light source 14 that falls on central reflector section 26 is directed in useful directions, minimizing the amount of light emitted from luminaire 10 in, and near, the direction of photometric axis P, and avoiding directing light energy back on primary light source 14 so the electrical characteristics of primary light source 14 will be stabilized.

FIG. 2 shows a perspective view of luminaire 10 along another specific line of sight. This line of sight corresponds (but in reverse) to the direction of another one of the main beams of light produced by luminaire 10 toward a particular point on the area lighted by the luminaire. The coordinates of that point as referred to an imaginary planar area zone grid (for this view of this particular embodiment of the invention) are 3.0 luminaire mounting distances forward and 3.0 luminaire mounting distances to the right. Reflector side section 13 directs a comparable beam of light to the left side of the planar area zone grid.

As shown in FIG. 2, fan-line facets 17A, 17B, 17C in tiered facet group 17 and fan-line facets 19A, 19B and 19C in tiered facet group 19 each have a cutoff edge that lies on a fan-line, and all of the fan-lines for each facet group intersect (if they are extended) at one point on fan-line vertex axis X. The fan-lines for each tiered facet group intersect at one point, but the intersection point is different for each group. Fan-line facets 17A, 17B, 17C, 19A, 19B and 19C are each given a spatial angle (using the CAD image plotting method) that creates, for the line of sight of this view, images 18A, 18B, 18C, 20A, 20B and 20C of primary light source 14 that are parallel and adjacent to the cutoff edge of the corresponding facet.

FIG. 3 shows a perspective view of luminaire 10 along another specific line of sight. This line of sight corresponds (but in reverse) to the direction of the last of the three main beams of light produced by luminaire 10 toward a particular point on the planar area zone lighted by the luminaire. The coordinates of that point as referred to an imaginary planar area zone grid (for this view of this particular embodiment of the invention) are zero luminaire mounting distances forward and 3.27 mounting heights to the right. Reflector section 13 directs a comparable beam of light to the left side of the planar area zone grid.

As shown in FIG. 3 fan-line facets 23A and 23B in tiered facet group 23 each have a cutoff edge that lies on a fan-line, and all of the fan-lines for this facet group intersect (if they are extended) at one point on fan-line vertex axis X. Fan-line facets 21A, 21B, 23A and 23B are each given a spatial angle (using the CAD image plotting method) that creates, for the line of sight of this view, images 22A, 22B, 24A and 24B of primary light source 14 that are parallel and adjacent to the cutoff edge of the corresponding facet.

Reflectors having fan-line geometry are extremely difficult (almost impossible) to design if a 3D CAD program having 3D mirroring and plane rotation commands is not used to develop the wire-frame geometry and reflector section stretchouts.

FIGS. 1, 2 and 3 show a particular embodiment of the invention where the adjacent edges of all fan-line facets are contiguous and of equal length (so called full shell construction). Two or more tiered facet groups are press formed (from highly specular reflector material) in one piece and secured to reflector mounting 25. This method of construction provides excellent reflector rigidity and ease of cleaning. Furthermore, such reflectors have a diamond like appearance that is aesthetically pleasing.

DETAILED DESCRIPTION—OTHER TYPES OF CONSTRUCTION

Other types of construction are feasible. They are:

(a) construction where the adjacent side edges of two or more tiered facet groups are not contiguous (where those edges are separated and/or stepped away from each other).

(b) construction where, facet rows, rather than tiered facet groups of fan-line facets are formed by strips of reflector material (tapered to a point or narrow end).

(c) construction as in (b) above, except where tiers of facet rows are stepped toward the light source (this configuration reduces beam strength).

I claim:

1. A luminaire comprising:

a reflector including specular or semi-specular reflecting facets, said reflector further including a photometric axis and an opening for emitting light from a light source to an area to be illuminated;

a primary light source mounted within said reflector, said primary light source having a diameter and a longitudinal axis which is substantially perpendicular to said photometric axis;

a fan-like vertex axis located substantially in parallel with the longitudinal axis of the light source, at a distance approximately equal to one-half of the light source diameter, and between said light source and said reflector;

a plurality of fan-lines, each fan-line originating from a point on or near the fan-line vertex axis;

a plurality of said reflecting facets being fan-line facets, each of said fan-line facets having a cutoff edge lying substantially on one of said fan-lines, said cutoff edge being the facet edge which lies furthest from the opening;

whereby an image of said light source is displayed by each of said fan-line facets in a given direction, each said image being parallel and adjacent to said cutoff edge for each of said fan-line facets.

2. The luminaire of claim 1 wherein said fan-line facets are disposed in a tiered facet group, said tiered facet group having a plurality of tiers, each of said tiers including one of said fan-line facets, the adjacent edges of said fan-line facets, within said tiered facet group, being substantially contiguous and of approximately equal length.

3. The luminaire of claim 2 wherein said tiered facet group is formed in one piece.

4. The luminaire of claim 2 wherein a plurality of said tiered facet groups are arranged substantially side by side.

5. The luminaire of claim 4 wherein each of said tiered facet groups is formed in one piece.

6. The luminaire of claim 4 wherein said plurality of said tiered facet groups have adjacent side edges that are substantially contiguous and of approximately equal length.

7. The luminaire of claim 6 wherein said plurality of said tiered facet groups are formed in one piece.

8. The luminaire of claim 1 wherein said fan-line facets are disposed in a facet row, said facet row having a plurality of said fan-line facets in single file, the adjacent edges of said fan-line facets, within said facet row, being substantially contiguous and of approximately equal length.

9. The luminaire of claim 8 wherein said facet row is formed in one piece.

10. The luminaire of claim 8 wherein a plurality of said facet rows are arranged substantially in tiers.

11. The luminaire of claim 10 wherein each of said facet rows is formed in one piece.

* * * * *